United States Patent [19]

Purdy

[11] 4,448,395

[45] May 15, 1984

[54] IMPROVEMENTS IN AND RELATING TO WINCHES

[75] Inventor: William C. Purdy, Barnehurst, England

[73] Assignee: Sykes Pumps Limited, London, England

[21] Appl. No.: 340,037

[22] Filed: Jan. 18, 1982

[30] Foreign Application Priority Data

Jan. 29, 1981 [GB] United Kingdom ..... 8102735

[51] Int. Cl.[3] ..... B66D 1/46; B66D 1/50; B66D 1/56; B66D 1/58

[52] U.S. Cl. ..... 254/334; 254/273; 254/277; 254/346; 254/375

[58] Field of Search ..... 254/273, 277, 334, 335, 254/346, 375

[56] References Cited

U.S. PATENT DOCUMENTS

| | | | |
|---|---|---|---|
| 2,244,830 | 6/1941 | Doe et al. | 254/277 X |
| 2,249,947 | 7/1941 | Doe | 254/277 X |
| 3,612,486 | 10/1971 | Martin et al. | 254/277 X |

*Primary Examiner*—John Petrakes

*Attorney, Agent, or Firm*—Sherman & Shalloway

[57] ABSTRACT

A winch arrangement intended for the rapid shifting of aircraft or other wheeled vehicles which incorporate their own braking system and which may be under the control of an occupant during winching, is so constructed as to provide compensation for wide fluctuations in load on the winch due to a possible lack of coordination between operation of the winch drive and the control of the vehicle. The winched arrangement comprises a drive motor, a winch drum assembly coupled to the drive motor by means of a transmission incorporating a reduction gear said transmission being of relatively high inertia, so that it can run on to drive the winch drum and take up slack in the winch rope in the event of stoppage of the drive motor. The transmission preferably includes an eddy current overload coupling. In order to prevent damage to the aircraft or vehicle due to the inertia of the transmission in the event of sudden shocks on the system, the path of the winch rope is deflected by guide means which can yield under load, the yielding of the guide means being controlled by a shock absorbing buffer means.

7 Claims, 5 Drawing Figures

IMPROVEMENTS IN AND RELATING TO WINCHES

BACKGROUND OF THE INVENTION

This invention concerns improvements in and relating to winches, and more especially to winches of the kind that may be subject to wide fluctuations in load during operation of the winch drive.

In the case of a winch arrangement that is intended for the rapid shifting of wheeled vehicles of a kind that incorporate their own braking system which may be under the control of an occupant of the vehicle during winching thereof, the winch arrangement may become subject to wide variations in load due to a lack of coordination between the operation of the winch drive and the operation of the braking system of the vehicle. This problem is especially acute in the case of a winch to be applied to aircraft which may need to be hauled rapidly into a hanger or other enclosure, since the efficiency of the braking system of an aircraft is such that very substantial and sudden loads can be placed on the winch rope, causing possible damage to the aircraft and/or the winch itself. Moreover, there is a requirement that slackness in the winch rope must be prevented in the event that an aircraft should overrun the winch, for example due to failure to apply the aircraft brakes following stoppage of the winch motor, and therefore means, operating independently of the winch motor, must be provided for taking up slack in the rope in these circumstances. In practice this could be provided for by arranging that the inertia of the system is such that this can run on to drive the winch drum after cease of drive from the drive motor, in order to wind up slack rope. This relatively high inertia of the system, however, would only increase the problems associated with sudden overloading of the winch rope.

SUMMARY OF THE INVENTION

It is accordingly an object of the present invention to provide a winch drive arrangement, the construction of which takes account of the conflicting requirements that the winch rope should not be subjected to sudden shocks and overloading, whilst the winch should be capable of running on under its own inertia to avoid the development of slack in the winch rope.

In accordance with the present invention there is provided a winch arrangement comprising a drive motor; a winch drum assembly coupled to said drive motor by means of a transmission incorporating a reduction gear, said transmission including a component of relatively high inertia, whereby in the event of sudden cease of drive from the drive motor the transmission can run on to drive the winch drum assembly and take up possible slack in the winch rope; rope guide means for guiding rope from a load to the winch drum along an indirect path; and shock absorbing buffer means associated with said guide means and arranged, upon sudden increase in the load in the winch rope above a predetermined limit, to allow deflection of the winch rope and to absorb the load placed on the rope due to the inertia of the system.

Preferably the above-mentioned transmission includes a non-return device arranged to prevent the winch drum from rotating in the reverse direction under the load placed on the winch rope, following stoppage of the transmission and the said transmission incorporates a releasable clutch means to enable manual unreeling of the winch rope prior to operation of the winch.

It will be appreciated that the release of such a clutch means must be effected under conditions wherein considerable stored energy may exist in the winch rope, and therefore there is a problem associated with the safe release of such stored energy, to permit uncoupling of the winch rope from the load, and, if desired, unreeling of the rope for a further operation of the winch drive.

In accordance with a further preferred feature of the present invention, therefore, the said clutch means comprises an electromagnetically actuatable clutch, the said winch drum is provided with an electromagnetically actuatable braking means, and there is further provided a control circuit incorporating a first timing circuit for controlling release of said clutch means, and a second timing circuit for release of said brake means, the said timing circuits being arranged for consecutive operation in timed relationship such that following release of said clutch means, the said brake means remains applied for a predetermined period of time sufficient to permit relaxation of tension in the winch rope.

The said brake and clutch operating circuits may incorporate a safety interlock with the operating circuit for the winch drive motor, to prevent operation thereof when the motor is running.

BRIEF DESCRIPTION OF THE DRAWINGS

IN THE DRAWINGS

Figure 1:
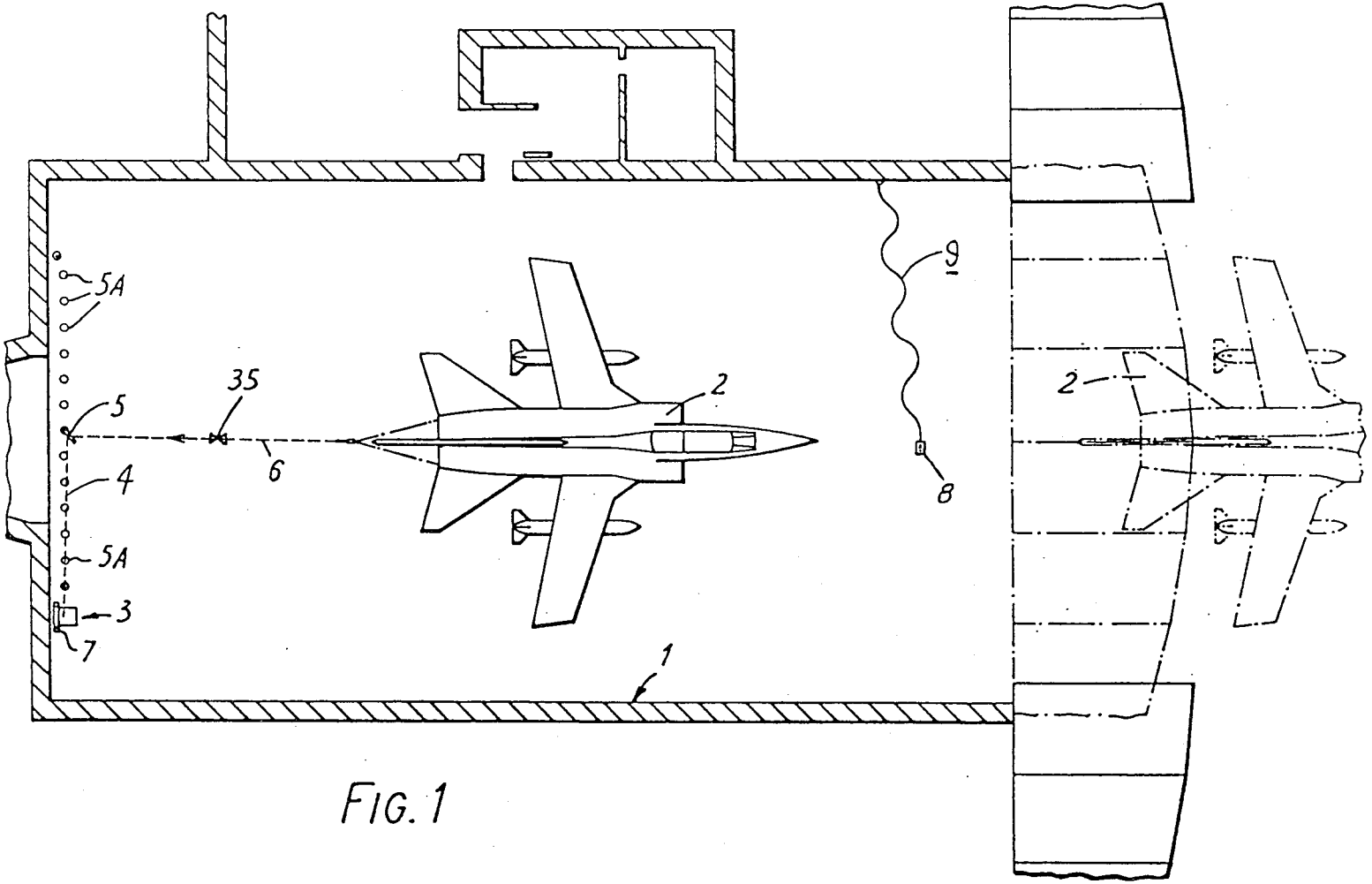
Figure 2:
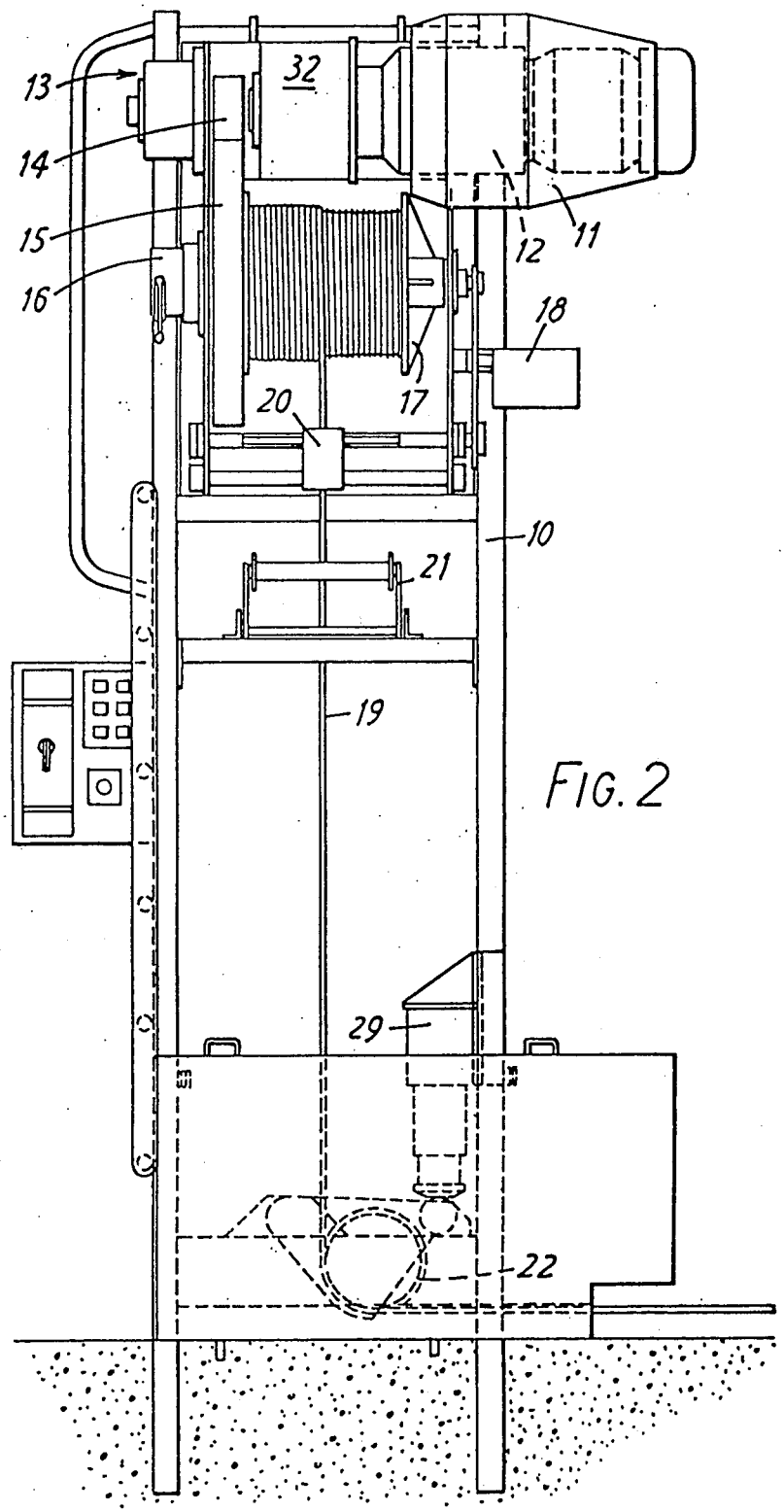
Figure 3:
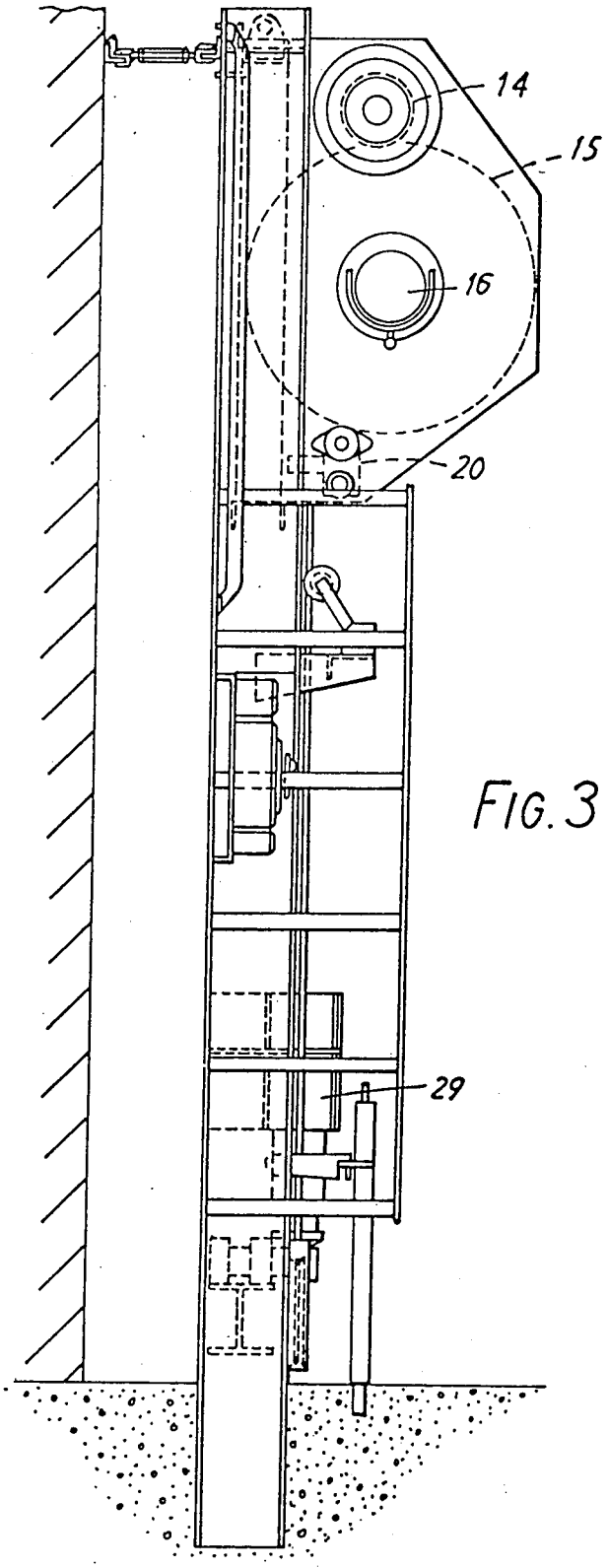
Figure 4:
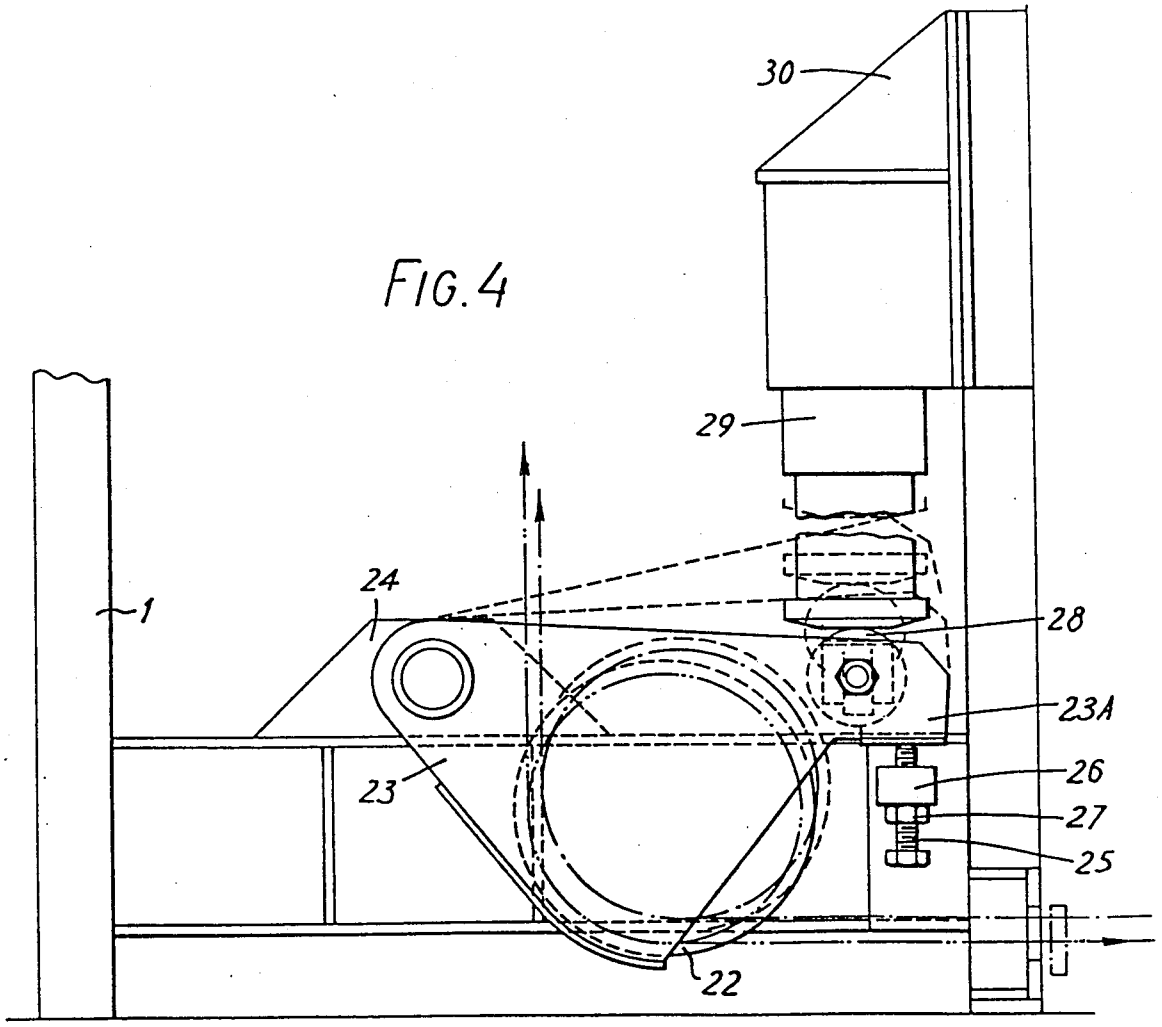
Figure 5:
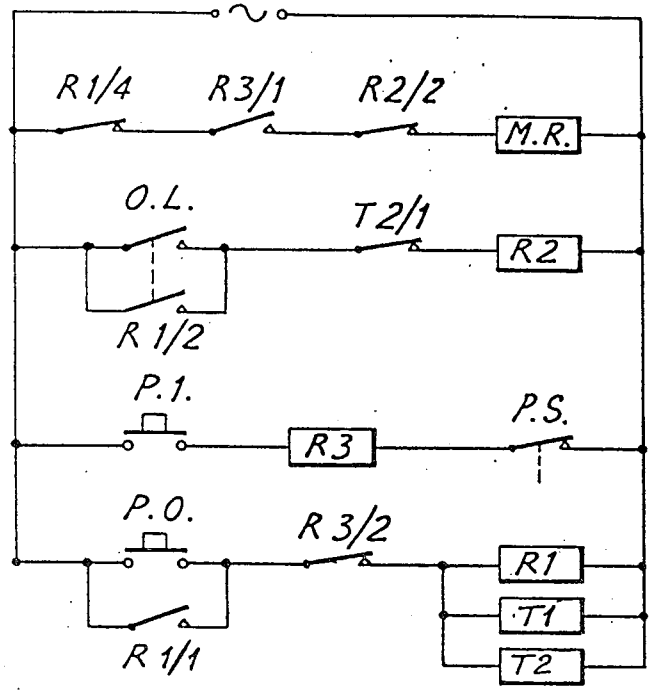
Figure 5:
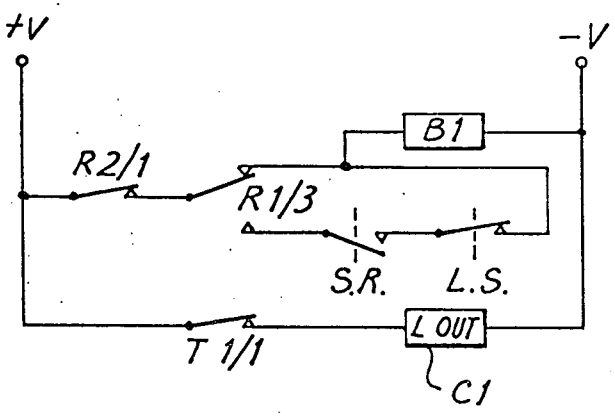

FIG. 1 is a diagrammatic plan view illustrating one example of an installation site of a winch arrangement in accordance with the invention, FIG. 2 is a front elevation of a winch drive in accordance with the invention, FIG. 3 is a side elevation corresponding to FIG. 2, FIG. 4 is an enlarged fragmentary view of a detail of FIG. 2, and FIG. 5 is a simplified circuit diagram illustrating an operating circuit for the winch arrangement of FIGS. 1 to 4.

DETAILED DESCRIPTION OF THE INVENTION

Referring now to FIG. 1, there is illustrated one possible site installation of a winch arrangement in accordance with the invention, which comprises an aircraft hanger or bomb shelter illustrated generally at 1. The purpose of the winch arrangement is to permit winching of an aircraft 2 into the position illustrated within the shelter, from a position outside the shelter and illustrated in broken lines. The winch drive assembly is thus located at the position indicated diagrammatically at 3, and the winch rope passes from the position 3, initially along a path 4, to a pulley 5 from which it passes along a path 6 to an attachment point at the rear of the aircraft. In order to enable preselection of a plurality of possible lateral positions of the aircraft, or any other load, to be towed, the pulley 5 is preferably releasable from its anchorage to enable location in any one of a plurality of desired mounting positions indicated at 5A. Manual operation of the winch drive may be effected from a local winch control panel indicated at 7, or, optionally, from a remote portable push button station indicated at 8 and connected to the control circuit by way of a flying cable 9.

Referring to FIGS. 2 and 3, the winch assembly comprises a fixed, vertical stand 10 at the upper end of which is mounted a winch drive motor 11 incorporating an eddy current, overload coupling 12 of generally known type. The output shaft from the eddy current coupling 12 is connected by way of a reduction gear 32 and an electromagnetically actuatable clutch device 13 to a drive pinion 14 which is in permanent meshing engagement with a driving gearwheel 15. The gearwheel 15 is fixed to a winch drum 17. The winch drum 17 is provided with an electromagnetically actuatable brake device 16. It is also coupled to a geared limit switch device 18 for indicating the limit positions of the fully wound and fully unwound winch rope 19. The winch rope 19 passes, via a rope layering device 20 and a safety switch 21 for sensing slackness in the rope, to a guide pulley 22, over which the winch rope 19 is deflected from its downward vertical path to a horizontal path corresponding to the path 4 illustrated in FIG. 1.

As shown in more detail in FIG. 4, the pulley 22 is mounted to the stand 1 by way of a lever arm 23 pivoted in a fixed mounting 24 secured to the frame. 1. A free end 23A of the lever arm 23 is normally located in a rest position defined by an adjusting bolt 25 threaded in a mounting 26, also secured to the stand 1, and locked in position by means of a lock nut 27. The end 23A of the lever 23 thus abuts against the free end of the adjusting bolt 25. At the end 23A of the lever 23, there is also mounted a roller 28 which is in engagement with the lower end of a shock absorbing buffer 29, which is of known type and secured to the stand 1 by means of a fixed mounting 30. The rating of the buffer 29 is such that under normal operating conditions of the winch arrangement the buffer remains in its extended position, but that upon excessive tension or overload occurring in the winch rope, the buffer will allow deflection of the lever arm 23 in an upward direction, as indicated in broken lines, thus allowing limited yielding of the winch rope in a direction towards the winch drum during such overload conditions.

The method of operation of the winch arrangement described above will now be explained with particular reference to FIG. 5, which is a simplified circuit diagram of the operating circuit of the winch arrangement. It will be seen that the circuit of FIG. 5 comprises two, electrically isolated portions, that on the left-hand side of FIG. 5 comprising a control circuit, and that on the right-hand side of FIG. 5 comprising an actuating circuit for the electromagnetic brake and clutch means referred to above. The positions of the switch and relay contacts illustrated in FIG. 5 correspond to a condition of the winch assembly wherein the winch rope is in a position intermediate its extreme wound and unwound positions, the rope is slack, and the control circuit is in an idle condition. Assuming that an aircraft such as that illustrated at 2 in FIG. 1 is to be winched from the position illustrated in broken lines, the winch rope must first be unwound to a starting position in order to enable attachment to the aircraft. The reduction gear 32 referred to above with reference to FIGS. 2 and 3 incorporates a non-return device preventing reverse rotation of transmission from the eddy current coupling 12. For unwinding of the rope 19, therefore, the electromagnetic clutch 13 must be released. For this purpose a push button of the local or remote push button control panel 7 or 8, illustrated diagrammatically at P.0. in FIG. 5, is depressed. Relay R1 thus becomes energised, and, at contact R1/1, completes a self-holding circuit to maintain energisation of the relay R1 upon release of the push button P.0. Simultaneously, relay contact R1/3 is changed over, so that the actuation circuit of an energising winding B1 of the electromagnetic brake 16 is broken, due to the open condition of the slack rope sensing switch 21, indicated diagrammatically at S.R. in FIG. 5. The electromagnetic brake 16 is of a fail safe construction, that is to say that the brake is held in the released condition when the winding B1 is energised, and is applied when the circuit of winding B1 is broken. Thus, upon initial actuation of the push button P.0., the winch drum 17 becomes braked against unwinding movement. It should be noted at this point that relay R1, at contact R1/2 has also completed an operating path to relay R2, thus also breaking the circuit of winding B1 at relay contact R2/1.

Following energisation of relay R1, a timer, or slow to operate relay, T1, which is connected in parallel with relay R1, becomes energised after a delay of, for example, 1 second. At its contact T1/1, the timer T1 breaks the circuit of an energising winding C1 of the electromagnetic clutch 13. The clutch 13 is a dog-clutch which is held in engagement upon energisation of the winding C1, and therefore the opening of contact T1/1 causes the clutch to be disengaged. The transmission between the coupling 12 and the winch drum 17 is thus broken to enable reverse movement of the winch drum 17, but initially the latter is retained against this movement by the braking device 16. After a delay of approximately 5 seconds, a second timer, or slow to operate relay, T2 becomes energised and, at its contact T2/1, breaks the circuit to the relay R2. Relay contact R2/1 is thus restored to its idle condition preparing an energising path to the brake winding B1. Assuming manual tension on the winch rope 19 sufficient to close the slack rope switch S.R., the brake winding B1 will now become energised and the electromagnetic brake 16 will thus be released to enable unwinding of the winch cable. When the winch rope has been unwound to its full extent as determined by the limit switch mechanism 18, a limit switch, indicated diagrammatically at L.S. in FIG. 5, will become opened, breaking the energising circuit of the brake winding B1 and causing the brake to be reapplied. The fully extended winch rope may now be attached to the aircraft to be towed into the hanger.

In order to tow the aircraft into the hanger, a push button switch on the local or remote control panel 7 or 8, and indicated diagrammatically at P.I. in FIG. 5, is depressed. Relay R3 thus becomes energised, and, at relay contact R3/2, breaks the holding circuit to relay R1, timer T1 and timer T2. Contact R3/1 of relay R3 also prepares a current path to a relay circuit for actuating the winch drive motor and indicated diagrammatically at M.R. The deenergisation of relay R1, timers T1 and T2, and consequently also relay R2, causes the relevant contacts to be restored to the positions illustrated in FIG. 5, thus causing the brake 16 to be released, the clutch 13 to be engaged, and the energising circuit to the motor control circuit M.R. to be completed by way of relay contacts R1/4 and R2/2. As long as the push button P.I. remains depressed, therefore, the winch drive motor 11 will remain energised to drive the winch, until the limit switch mechanism 18 opens switch contacts P.S. in the circuit of relay R3.

It will be appreciated that during winching of the aircraft 2 into its hanger, the aircraft itself remains under the control of an occupant of the aircraft, who is required to coordinate braking of the aircraft to a standstill in coordination with the actions of the winch operator. Owing to potential human error, however, a number of fault conditions may possibly occur during the winch operating and compensation for such conditions must therefore be provided. These possible conditions will now be discussed below.

1. Slackness in the winch rope

In the absence of appropriate precautions, slackness in the winch rope might possibly occur due, for example, to stoppage of the winch drive combined with failure to apply the brakes of the aircraft, so that the aircraft over-runs the winch drive. In the illustrated arrangement, however, the inertia in the system and attributable primarily to the eddy current coupling 12, will cause the drive transmission to run on in the event that the motor 11 ceases to provide drive, so that the winch drum 17 continues to be driven to wind in the rope 19 following stoppage of the motor 11.

2. Sudden overloading of the winch drive

Although the winch drive motor 11 may, in known manner, be protected against overloading by means of the eddy current coupling 12 which serves as a torque limiting device, in the event of very sudden overloads upon the winch arrangement, for example by sudden application of the aircraft brakes whilst the winch drive is running, the overloading will initially appear as a shock upon the winch drum and its associated transmission. Owing to its own inertia, very sudden overloading will not be sensed at the eddy current coupling 12 until damage has already been caused to the winch drive and/or the aircraft, due to the tendency of the eddy current coupling 12 to run on under its own inertia. Overloading in the latter circumstances is compensated for by means of the pulley 22 and the associated buffer arrangement. Since the pulley 22 is located at a position of deflection of the path of the winch rope 19, any sudden load on the pulley 22 will tend to apply an upward force thereto, thus pivoting the mounting lever 23 in the mounting 24. Under normal loads such pivoting movement is resisted by engagement of the roller 28 with the buffer 29, but in the event of excessive tension in the rope the buffer 29 can yield in an upward direction thus reducing the length of the cable extending between the winch drum 17 and the pulley 5 of FIG. 1, and serving to cushion strain in the rope. It will be appreciated that the characteristics of the buffer 29 should be carefully matched to the inertia of the system in order to provide for the optimum shock absorption. The lever arm 23 is coupled, in a manner not shown in the drawing, to an overload sensing microswitch, indicated diagrammatically at 0.L. in FIG. 5, whereby the microswitch is closed upon deflection of the lever 23. Thus in an overload condition the relay R2 becomes energised to effect stoppage of the drive motor 11 by way of relay contact R2/2 which breaks the energising circuit of the motor relay M.R.

Owing to the non-return device in the transmission from the eddy current coupling 12, it will be appreciated that following the occurrence of condition 2 described above, considerable tension will exist in the winch cable. In the event that the tension cannot be released by removing the load from the winch rope itself, the winch arrangement can be restored to an idle condition by depression of the pull out button P.0. of the control circuit of FIG. 5. The corresponding operation of the control circuit is as already described above, but it will be noted that since, in this condition, relay R2 is energised and the slack rope switch S.R. is closed, the above-described action of the timers T1 and T2 is essential in order to ensure that the winch drum 17 is initially held in a braked condition following release of the clutch 13, braking being maintained for a period of time sufficient to allow relaxation of tension in the winch rope without danger or possible faulty operation due to sudden return movement of the winch drum 17.

Thus it will be seen from the above description that there has been provided a novel winch arrangement which is capable of safe and reliable operation under severe fluctuations in load whilst providing compensation both for possible slackness developing in the winch rope and also for sudden shocks due to sudden stoppage of the load being winched, or possible jamming of the winch rope. This arrangement also makes it possible to place a safety stop, for example in the form of a dumb-bell 35 (FIG. 1), on the winch rope to prevent inadvertent overwinding of the winch rope and possible damage to a towed aircraft. It will be appreciated that in view of the variety of possible positions 5A of the pulley 5 such safety stoppage cannot always be provided by the limit switch associated with the winch drum 17. Thus, if the dumb-bell 35 should jam up against the pulley 5 during actuation of the winch the above-mentioned shock absorbing function will also be provided until stoppage of the winch drive.

I claim:

1. A winch arrangement comprising a drive motor; a winch drum assembly coupled to said drive motor by means of a transmission incorporating a reduction gear, said transmission including a component of relatively high inertia, whereby in the event of sudden cease of drive from the drive motor the transmission can run on to drive the winch drum assembly and take up possible slack in the winch rope; rope guide means for guiding rope from a load to the winch drum along an indirect path; and shock absorbing buffer means associated with said rope guide means and arranged, upon sudden increase in the load in the winch rope above a predetermined limit, to allow deflection of the winch rope and to absorb the load placed on the rope due to the inertia of the system; said transmission including a non-return device arranged to prevent the winch drum from rotating in the reverse direction under the load placed on the winch rope, following stoppage of the transmission, and the said transmission incorporates a releasable clutch means to enable manual unreeling of the winch rope prior to operation of the winch, said clutch means comprising an electromagnetically actuatable clutch, the said winch drum is provided with an electromagnetically actuatable braking means, and there is further provided a manually operable control circuit incorporating an actuating switch for controlling release of said clutch means, and a timing circuit for controlling release of said brake means, the said timing circuit being arranged to delay release of said brake means following release of said clutch means so that the said brake means remains applied for a predetermined period of time sufficient to permit relaxation of tension in the winch rope.

2. An arrangement as claimed in claim 1, wherein the said brake and clutch operating circuits incorporate a safety interlock with the operating circuit for the winch drive motor, to prevent operation thereof when the motor is running.

3. An arrangement as claimed in claim 2, wherein said braking means is of the fail-safe type, wherein the brake is released when energised by an electric current, and the said control circuit includes a switch contact for initially breaking the current circuit of said braking means upon manual operation of the said control circuit, and a further timing circuit for delaying release of the clutch means for a period greater than the response time of said braking means.

4. An arrangement as claimed in claim 3, wherein said control circuit further includes a changeover contact for switching into the current circuit of said braking means, a slack rope sensing switch arranged to be opened when the winch rope is in a slack condition, and a limit switch arranged to be opened when the winch rope is unwound to its full extent.

5. An arrangement as claimed in claim 1 wherein said winch drum assembly is located in an elevated position upon a tower-like framework, said rope guide means comprises a pulley mounted upon a pivoted lever arm at the base of said framework and arranged to deflect the winch rope from a vertically downward to a horizontal path, and said buffer means is arranged to engage said lever arm at a point spaced from the pivot thereof.

6. An arrangement as claimed in claim 5, wherein said rope guide means further includes a further pulley arranged to deflect the horizontal path of the winch rope through 90°, said pulley being optionally mountable in one of a plurality of different horizontally spaced positions, in accordance with the position of the load, and said winch rope having attached thereto, at a point between said pulley and the free end to be attached to the load, a blocking member for engagement with the pulley to limit movement of the load.

7. An arrangement as claimed in claim 1, wherein said transmission includes an eddy current overload coupling.

* * * * *